US009837772B2

(12) United States Patent
Tsai et al.

(10) Patent No.: US 9,837,772 B2
(45) Date of Patent: Dec. 5, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Rui Su, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/361,196

(22) Filed: Nov. 25, 2016

(65) Prior Publication Data

US 2017/0155215 A1 Jun. 1, 2017

(30) Foreign Application Priority Data

Nov. 26, 2015 (CN) ..... 2015 2 0953468 U

(51) Int. Cl.

| | |
|---|---|
| ***H01R 13/648*** | (2006.01) |
| ***H01R 24/60*** | (2011.01) |
| ***H01R 13/502*** | (2006.01) |
| ***H01R 13/6585*** | (2011.01) |
| *H01R 107/00* | (2006.01) |

(52) U.S. Cl.
CPC ..... *H01R 24/60* (2013.01); *H01R 13/502* (2013.01); *H01R 13/6585* (2013.01); *H01R 2107/00* (2013.01)

(58) Field of Classification Search
CPC ..... H01R 2107/00; H01R 13/6585; H01R 13/502; H01R 24/60
USPC .. 439/660, 108, 607.01, 637, 607.4, 607.36, 439/607.35
See application file for complete search history.

(56) References Cited

U.S. PATENT DOCUMENTS

| | | | | |
|---|---|---|---|---|
| 6,113,426 A * | 9/2000 | Lin | H01R 12/725 | 439/607.43 |
| 6,945,824 B1 * | 9/2005 | Li | H01R 13/26 | 439/660 |
| 7,083,468 B2 * | 8/2006 | Walker | H01R 13/6658 | 439/541.5 |
| 7,758,379 B2 * | 7/2010 | Chen | H01R 13/6485 | 439/607.11 |

(Continued)

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

An electrical receptacle connector includes a mount member, a tongue, first terminals, second terminals, and a shielding plate. The mount member and the tongue are received in a metallic shell. The terminals and the shielding plate are on the mount member and the tongue. The tongue includes terminal grooves and recesses. The terminal grooves are formed on a first surface of the tongue. Each of the recesses is recessed toward a tip of the tongue from an inner sidewall in the corresponding terminal groove. Flat contact portions of the first terminals are held in the terminal grooves. End portions of the flat contact portions are received in the recesses. Therefore, upon the tongue is deflected, the flat contact portions are constrainted in the recesses and not detached from the tongue, thereby improving stability and reliability in the contact with an electrical plug connector.

15 Claims, 7 Drawing Sheets

(56) References Cited

U.S. PATENT DOCUMENTS 7,841,904 B2 * 11/2010 Lin ..... G02B 6/3817 439/660
8,851,927 B2 * 10/2014 Hsu ..... H01R 12/724 439/607.11
9,209,573 B1 * 12/2015 Chen ..... H01R 13/6581
9,252,542 B2 * 2/2016 Little ..... H01R 13/6585
2001/0049227 A1 * 12/2001 Zhu ..... H01R 13/65802 439/607.01
2008/0242149 A1 * 10/2008 Konno ..... H01R 24/58 439/607.01
2011/0250783 A1 * 10/2011 Su ..... H01R 4/2433 439/404
2013/0143441 A1 * 6/2013 Huang ..... H01R 27/00 439/607.01
2015/0194772 A1 * 7/2015 Little ..... H01R 13/6597 439/357
2015/0255905 A1 * 9/2015 Little ..... H01R 13/6658 439/78
2015/0372424 A1 * 12/2015 Little ..... H01R 13/642 439/217
2016/0104975 A1 * 4/2016 Guo ..... H01R 13/6585 439/607.05
2016/0104976 A1 * 4/2016 Yu ..... H01R 13/6585 439/607.05
2016/0118750 A1 * 4/2016 Guo ..... H01R 13/6585 439/78
2016/0141792 A1 * 5/2016 Zhao ..... H01R 13/6581 439/78
2016/0141806 A1 * 5/2016 Guo ..... H01R 13/504 439/607.01
2016/0149349 A1 * 5/2016 Kao ..... H01R 13/6586 439/607.05
2016/0149350 A1 * 5/2016 Kao ..... H01R 24/60 439/607.05
2016/0197442 A1 * 7/2016 Lin ..... H01R 13/6585 439/607.05
2016/0197443 A1 * 7/2016 Zhang ..... H01R 13/6585 439/607.05

* cited by examiner

100

100

ELECTRICAL RECEPTACLE CONNECTOR

CROSS-REFERENCE TO RELATED APPLICATION

This non-provisional application claims priority under 35 U.S.C. §119(a) to Patent Application No. 201520953468.2 filed in China, P.R.C. on Nov. 26, 2015, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. Normally, the plastic core of a conventional USB type-C electrical receptacle connector is an assembly of several plastic components, and the upper receptacle terminals and the lower receptacle terminals are respectively assembled with the plastic components.

SUMMARY OF THE INVENTION

The flat contact portions of the receptacle terminals of the conventional receptacle connector are originally attached on the surface of a front portion of the tongue portion. However, when the tongue portion is deflected upward or downward due to swaying of the plastic core, the flat contact portions might be detached from the tongue portion. Hence, in operation, the receptacle terminals of the electrical receptacle connector would not contact the plug terminals of an electrical plug connector efficiently due to the flat contact portions of the receptacle terminals are detached from the tongue portion. Therefore, how to solve the aforementioned problem is an issue.

In view of this, an embodiment of the instant disclosure provides an electrical receptacle connector. The electrical receptacle connector comprises a metallic shell, a mount member, a tongue portion, a plurality of first receptacle terminals, a plurality of second receptacle terminals, and a shielding plate. The metallic shell comprises a receptacle cavity. The mount member is received in the receptacle cavity of the metallic shell. The tongue portion is integrally formed on one of two sides of the mount member. The tongue portion comprises a plurality of terminal grooves and a plurality of recesses. The terminal grooves are formed on a first surface of the tongue portion. Each of the recesses is recessed toward a tip of the tongue portion from an inner sidewall in the corresponding terminal groove. Each of the recesses comprises two lateral surfaces and a bottom surface therein. For each of the recesses, a first lateral surface of the two lateral surfaces is extending from the inner sidewall toward an interior of the recess and connected to one of two opposite edges of the bottom surface, and a second lateral surface of the two lateral surfaces is extending from an inner surface of the corresponding terminal groove toward the interior of the recess and connected to the other edge of the bottom surface. The first receptacle terminals are on a first side of the mount member. Each of the first receptacle terminals comprises a first flat contact portion and a first tail portion extending from one end of the first flat contact portion and protruding from the mount member. The first flat contact portions are held in the terminal grooves. End portions of the first flat contact portions are received in the recesses. Abutting surfaces of the end portions of the first flat contact portions are abutted against the first lateral surfaces of the recesses. The second receptacle terminals are on a second side of the mount member opposite to the first side. Each of the second receptacle terminals comprises a second flat contact portion and a second tail portion extending from one end of the second flat contact portion and protruding from the mount member. The second flat contact portions are held on a second surface of the tongue portion opposite to the first surface. The shielding plate is on the mount member and the tongue portion. The shielding plate is between the first flat contact portions and the second flat contact portions.

In one embodiment, the tongue portion comprises a plurality of limiting blocks formed on the first lateral surfaces of the recesses. The end portions of the first flat contact portions are abutted against the limiting blocks, respectively.

In one embodiment, the tongue portion comprises a plurality of through holes formed on a front lateral surface of the tongue portion and respectively communicating with the recesses.

In one embodiment, each of the first flat contact portions comprises a positioning portion and a slant portion outward extending from the positioning portion, and an end portion of the slant portion is inserted into the corresponding recess.

In one embodiment, each of the first flat contact portions comprises a positioning portion and a parallel portion parallel to and outward extending from the positioning portion, and an end portion of the parallel portion is inserted into the corresponding recess.

In one embodiment, the tongue portion comprises a plurality of protruding blocks respectively protruding from groove walls of the terminal grooves to abut against bottoms of the first flat contact portions.

In one embodiment, the mount member further comprises a first terminal base and a second terminal base. The first terminal base is assembled with the first receptacle terminals. The second base is integrally formed with the tongue portion and is assembled with the second receptacle terminals. The first terminal base is assembled on the second terminal base.

In one embodiment, the mount member comprises a plurality of first assembling grooves, and the first receptacle terminals are assembled in the first assembling grooves, respectively.

In one embodiment, the mount member comprises a plurality of second assembling grooves, and the second receptacle terminals are assembled in the second assembling grooves, respectively.

In one embodiment, the first receptacle terminals are on the first surface of the tongue portion, the second receptacle terminals are on the second surface of the tongue portion. The first receptacle terminals and the second receptacle terminals have 180 degree symmetrical design with respect to a central point of the receptacle cavity as the symmetrical center.

As above, recesses are provided in the terminal grooves for receiving end portions of the flat contact portions of the first receptacle terminals, and the abutting surfaces of the end portions are abutted against the first lateral surfaces of the recesses. Therefore, when the tongue portion is inserted into or detached from an electrical plug connector, the end portions are constrainted in the recesses. As a result, upon the tongue portion is deflected, the flat contact portions are not detached from the tongue portion. Accordingly, the connector can provide good stability and reliability in the contact with the electrical plug connector. Moreover, the tongue portion comprises the through holes formed on the front lateral surface thereof and communicating with the recesses, respectively. Therefore, the recesses can be manufactured conveniently, and fixtures can be taken out of the tongue portion through the through holes after the recesses are manufactured. Additionally, the flat contact portions of the first receptacle terminals comprise the slant portions. When the slant portions are received in the terminal grooves, the slant portions continuously abut against the groove walls of the terminal grooves to prevent the flat contact portions from detaching off the tongue portion.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
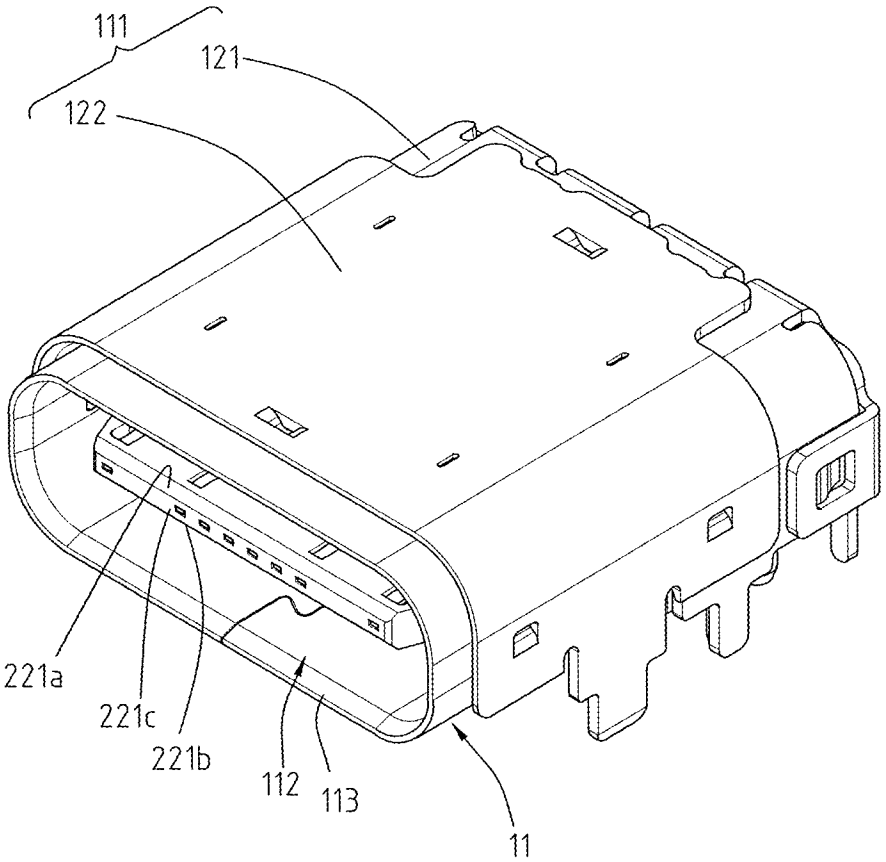
FIG. 1 illustrates a perspective view of an electrical receptacle connector according to an exemplary embodiment of the instant disclosure.
Figure 2:
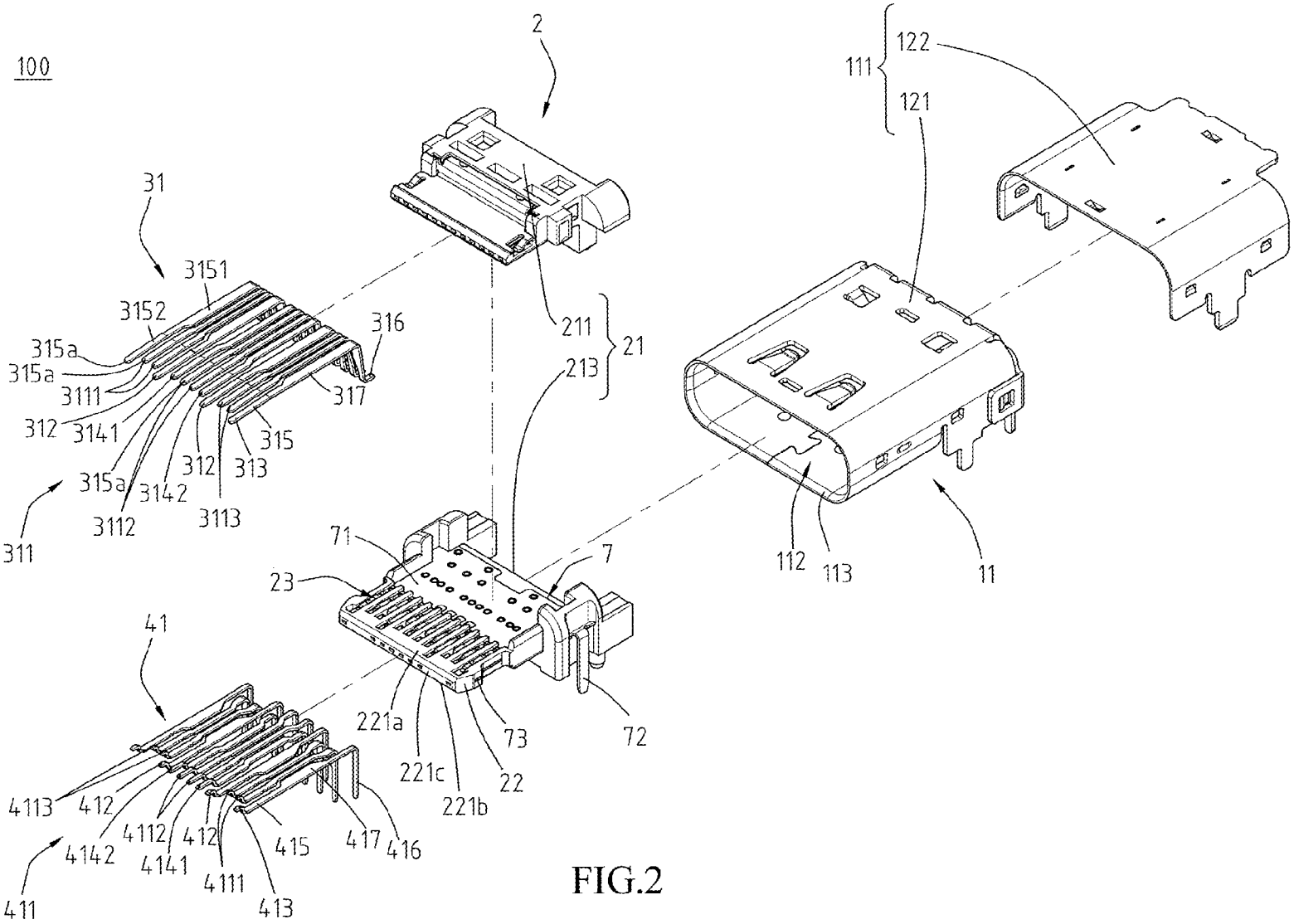
FIG. 2 illustrates an exploded view of the electrical receptacle connector.

Please refer to FIGS. 1 and 2, illustrating an electrical receptacle connector of an exemplary embodiment of the instant disclosure. FIG. 1 illustrates a perspective view of an electrical receptacle connector according to an exemplary embodiment of the instant disclosure. FIG. 2 illustrates an exploded view of the electrical receptacle connector. In this embodiment, the electrical receptacle connector 100 is assembled with a circuit board by sinking technique. That is, one side of the circuit board is cut to form a crack, and the electrical receptacle connector 100 is positioned at the crack and extending toward the side portion of the circuit board. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, a mount member 21, a tongue portion 22, a plurality of first receptacle terminals 31, a plurality of second receptacle terminals 41, and a shielding plate 7.

Please refer to FIGS. 1 and 2. In this embodiment, the metallic shell 11 is a hollowed shell, and the metallic shell 11 comprises a shell body 111 and a receptacle cavity 112 formed in the shell body 111. In other words, the metallic shell 11 comprises a receptacle cavity 112 for receiving the first receptacle terminals 31 and the second receptacle terminals 41. In this embodiment, the metallic shell 11 may be a tubular member and the receptacle cavity 112 is formed in the tubular member. The metallic shell 11 may be formed by a multi-piece member; in such embodiment, the metallic shell 11 comprises an inner shell 121 and a cover shell 122, wherein the inner shell 121 is a tubular member and encloses the mount member 21, and the cover shell 122 has a U-shape cross section and covers the top and the two sides of the inner shell 121, but embodiments are not limited thereto. In some embodiments, the cover shell 122 may be a hollowed shell and encloses the inner shell 121. In addition, an insertion opening 113 with oblong shaped is formed on one side of the metallic shell 11, and the insertion opening 113 communicates with the receptacle cavity 112.

Please refer to FIG. 2. In this embodiment, a terminal module 2 is received in the receptacle cavity 112 of the metallic shell 11. The terminal module 2 comprises the mount member 21, the tongue portion 22, the first receptacle terminals 31, the second receptacle terminals 41, and the shielding plate 7.

Figure 7:
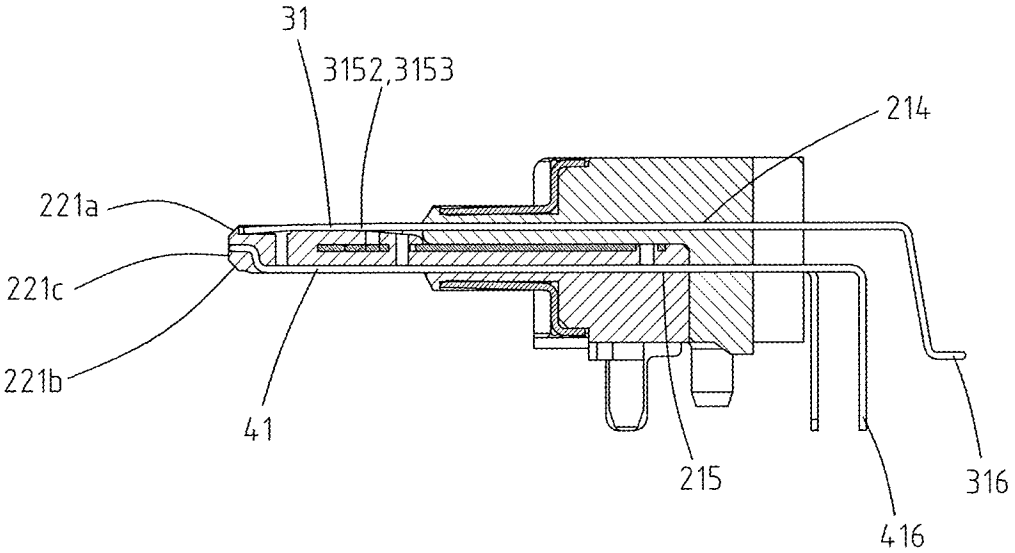
FIG. 7 illustrates a lateral sectional view of another embodiment of the assembly of the electrical receptacle connector.

Please refer to FIGS. 2 to 5. In this embodiment, the mount member 21 is received in the receptacle cavity 112 of the metallic shell 11. The mount member 21 comprises a first terminal base 211 and a second terminal base 213 assembled with each other. The first receptacle terminals 31 are on the first terminal base 211, and the second receptacle terminals 41 and the shielding plate 7 are on the second terminal base 213. The second terminal base 213 is integrally formed with the tongue portion 22, and the first terminal base 211 is assembled on the second terminal base 213, but embodiments are not limited thereto. In some embodiments, the first terminal base 211 and the second terminal base 213 may be further integrally formed as a whole, and the mount member 21 comprises a plurality of first assembling grooves 214 and a plurality of second assembling grooves 215 (as shown in FIG. 7). The first receptacle terminals 31 are assembled in and engaged with the first assembling grooves 214, respectively, and the second receptacle terminals 41 are assembled in and engaged with the second assembling grooves 215, respectively. Accordingly, the connector may have different assembling ways so as to increase the applicability of the connector product.

Figure 3:
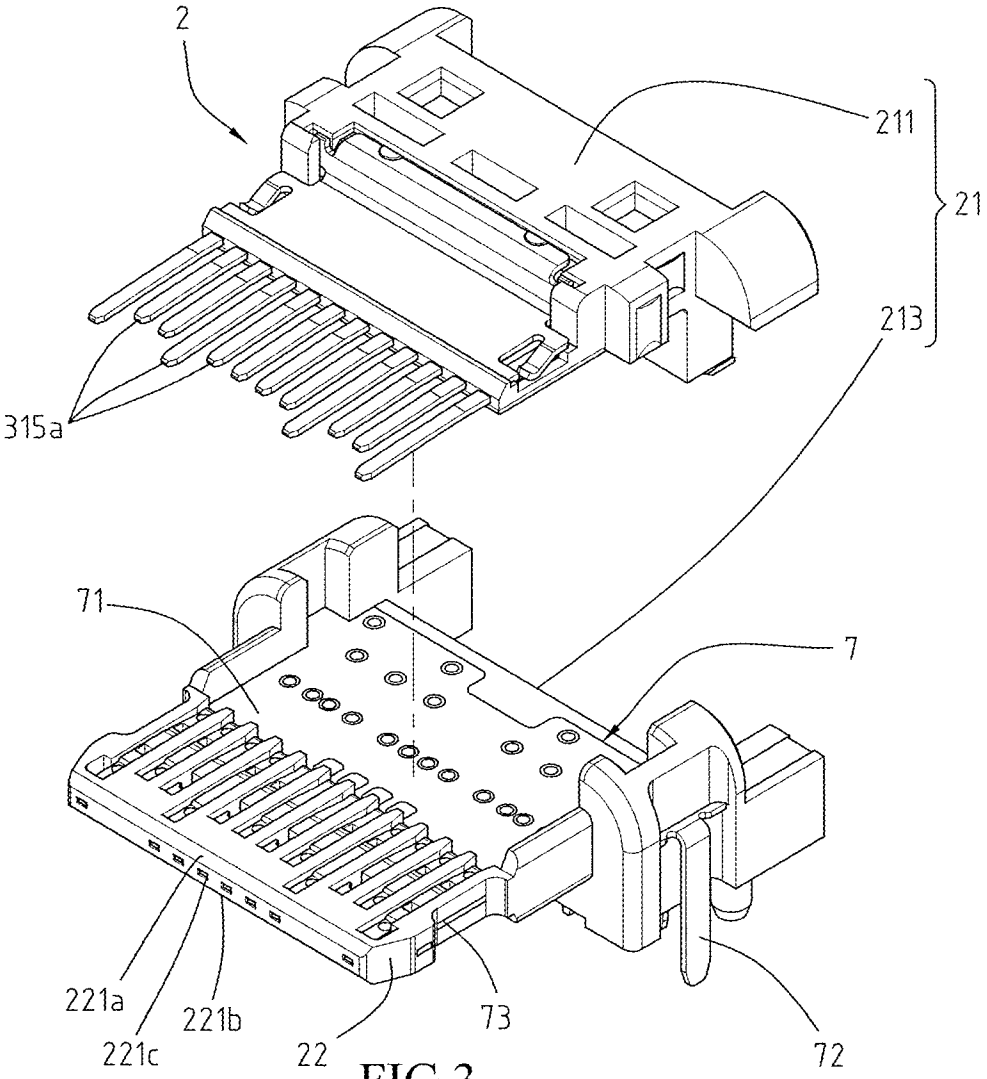
FIG. 3 illustrates an another exploded view of the electrical receptacle connector.
Figure 5:
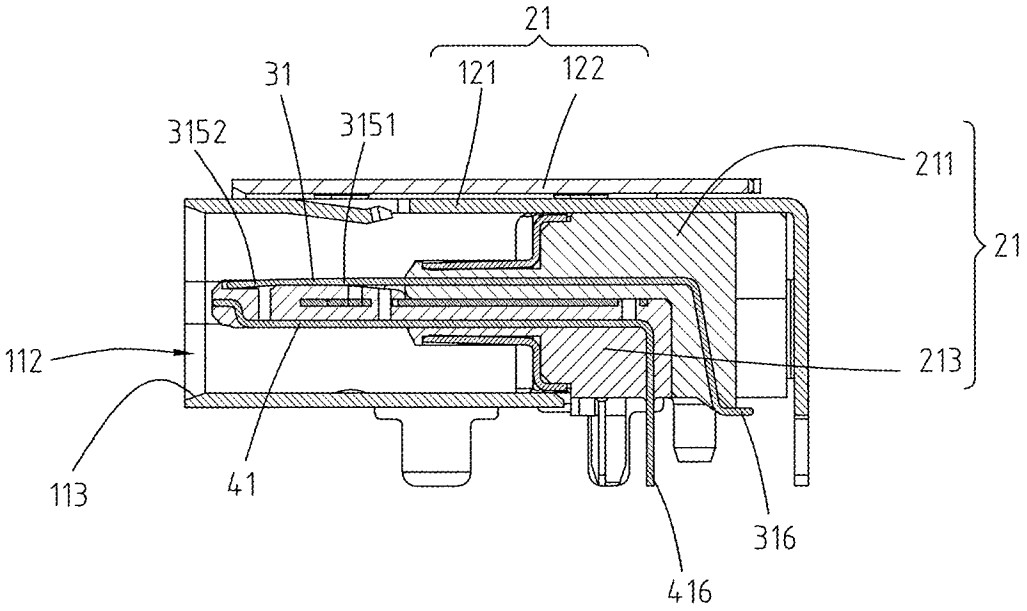
FIG. 5 illustrates an lateral sectional view of the assembled electrical receptacle connector shown in FIG. 3.

Please refer to FIGS. 2, 3, and 5. The tongue portion 22 has two opposite surfaces, one is a first surface 221*a*, and the other is the second surface 221*b*. In addition, a front lateral surface 221*c* of the tongue portion 22 is connected the first surface 221*a* with the second surface 221*b* and is close to the insertion opening 113. In other words, the front lateral surface 221*c* is near the insertion opening 113 and perpendicularly connected to the first surface 221*a* and the second surface 221*b*, respectively.

Please refer to FIGS. 2, 3, 5, and 6A. In this embodiment, the tongue portion 22 is integrally formed with the mount member 21 and formed on one side of the mount member 21. The tongue portion 22 comprises a plurality of terminal grooves 23 and a plurality of recesses 24. The terminal grooves 23 are formed on a surface (i.e., the first surface 21*a*) of the tongue portion 22. The terminal grooves 23 are provided for assembling the flat contact portions 315 of the first receptacle terminals 31 therein. Each of the recesses 24 is recessed toward a tip of the tongue portion 22 from an inner sidewall 23*a* in the corresponding terminal groove 23. Each of the recesses 24 comprises two lateral surfaces 241, 242 and a bottom surface 243. For each of the recesses 24, a first lateral surface 241 is extending from the inner sidewall 23*a* toward the interior of the recess 24 and connected to one of two opposite edges of the bottom surface 243, a second lateral surface 242 is extending from an inner surface 23*b* of the corresponding terminal groove 23 toward the interior of the recess 24 and connected to the other edge of the bottom surface 243. Furthermore, the tip of the tongue portion 22 is near the insertion opening 113. The end portions 315*a* of the flat contact portions 315 are received in the recesses 24, and abutting surfaces of the end portions 315*a* of the flat contact portions 315 are abutted against the first lateral surfaces 241 of the recesses 24. Hence, when the tongue portion 22 is inserted into or detached from an electrical plug connector, the end portions 315*a* of the flat contact portions 315 are constrainted in the recesses 24. Therefore, once the tongue portion 22 is deflected upward or downward, the flat contact portions 315 will not detach from the tongue portion 22. Accordingly, the connector can provide good stability and reliability in the contact with the electrical plug connector. In detail, in this embodiment, the recess 24 is recessed from one side of the terminal groove 23; that is, the tongue portion 22 comprises a plurality of limiting blocks 223 respectively formed on the first lateral surfaces 241 of the recesses 24, and the end portions 315*a* of the flat contact portions 315 are abutted against and limited by the limiting blocks 223. Hence, the end portions 315*a* of the flat contact portions 315 can be prevented from being detached from the tongue portion 22. Therefore, connector can provide stable contact and transmission with the electrical plug connector.

Figure 6B:
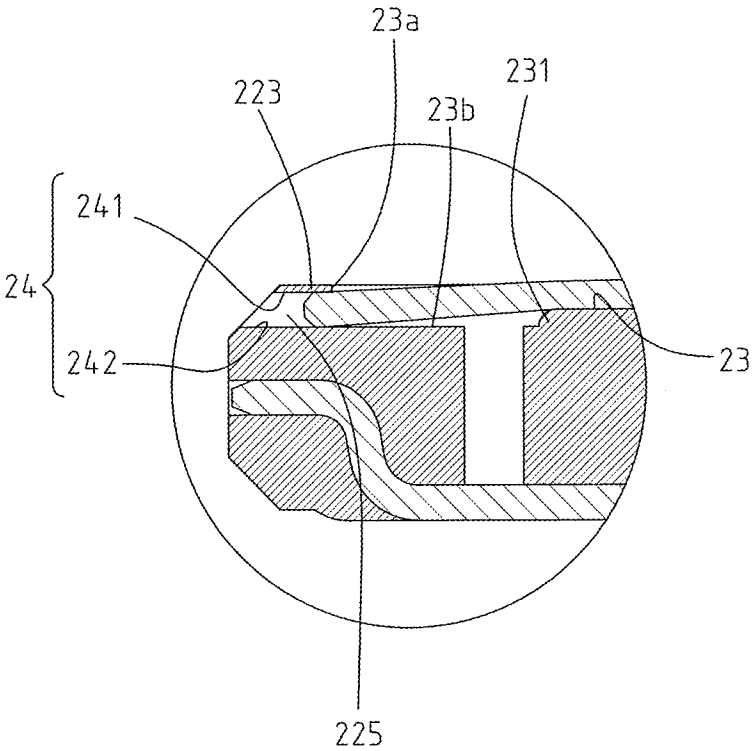
FIG. 6B illustrates a partial enlarged view showing an end portion of a first flat contact portion is received in a recess in which the recess runs through the tongue portion.

In the foregoing embodiment, the recess 24 is formed on one side of the terminal groove 23 but not runs through the tongue portion 22. In some embodiments, the tongue portion 22 may further comprise a plurality of through holes 225 (as shown in FIG. 6B). The through holes 225 are formed on the front lateral surface 22*c* of the tongue portion 22 and respectively communicating with the recesses 24. In other words, from a front view of the connector, the through holes 225 can be seen, and the through holes 225 are penetrating to the recess 24. Accordingly, in the formation of the tongue portion 22, the recesses 24 can be manufactured conveniently, and fixtures can be taken out of the tongue portion 22 through the through holes 225 after the recesses 24 are manufactured.

Please refer to FIGS. 2, 3, 4, and 6A. In this embodiment, the first receptacle terminals 31 are held in the first terminal base 211. Each of the first receptacle terminals 31 comprises a flat contact portion 315 and a tail portion 316. The flat contact portions 315 are positioned in the terminal grooves 23, and front ends 315*a* of the flat contact portions 315 are received in the recesses 24. Each of the tail portions 316 is extending from one end of the corresponding flat contact portion 315 and protruding from the mount member 21. In this embodiment, each of the flat contact portions 315 comprises a positioning portion 3151 and a slant portion 3152 outward extending from the positioning portion 3151, and an end portion of the slant portion 3152 (i.e., the end portion 315*a*) is inserted into the corresponding recess 24. Accordingly, since the slant portion 3152 is bent downward to create an angle with the positioning portion 3151, when the slant portions 3152 are received in the terminal grooves 23, the slant portions 3152 continuously abut against the groove walls of the terminal grooves 23 to prevent the flat contact portions 315 from detaching off the tongue portion 22.

It is understood that, the flat contact portions 315 with the slant portions 3152 are for illustrative purposes. Alternatively, each of the flat contact portions 315 may comprise the positioning portion 3151 and a parallel portion 3153 parallel to and outward extending from the positioning portion 3151 (as shown in FIG. 7), and an end portion of the parallel portion 3153 (i.e., the end portion 315*a*) is inserted into the corresponding recess 24.

Figure 6A:
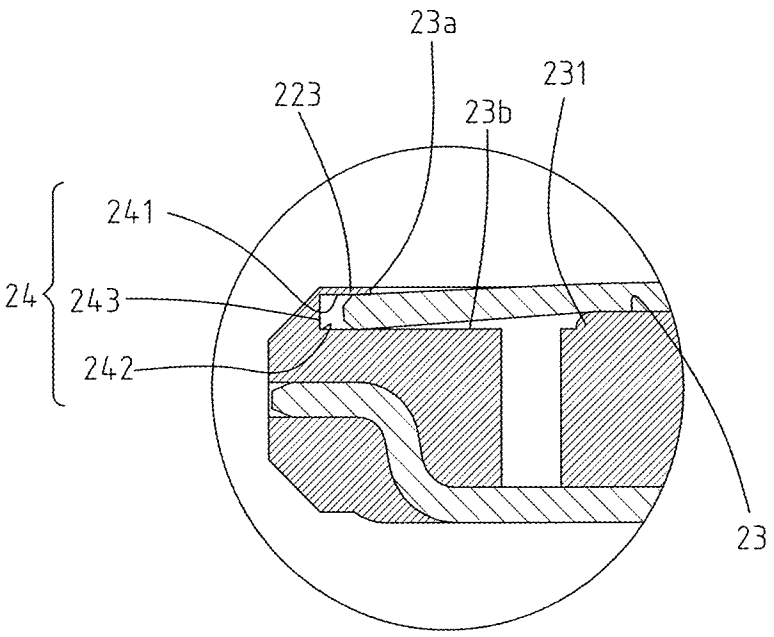
FIG. 6A illustrates a partial enlarged view showing an end portion of a first flat contact portion is received in a recess.

In this embodiment, the tongue portion 22 comprises a plurality of protruding blocks 231 (as shown in FIG. 6A). The protruding blocks 231 are respectively protruding from groove walls of the terminal grooves 23 to abut against bottoms of the flat contact portions 315. The protruding blocks 231 are in the terminal grooves 23 to make the groove walls of the terminal grooves 23 have different thicknesses. Accordingly, when the slant portions 3152 are assembled in the terminal grooves 23, the protruding blocks 231 are abutted against bottoms of the slant portions 3152, and the end portions of the slant portions 3152 are slantly received in the recesses 24 and positioned by the recesses 24.

Figure 4:
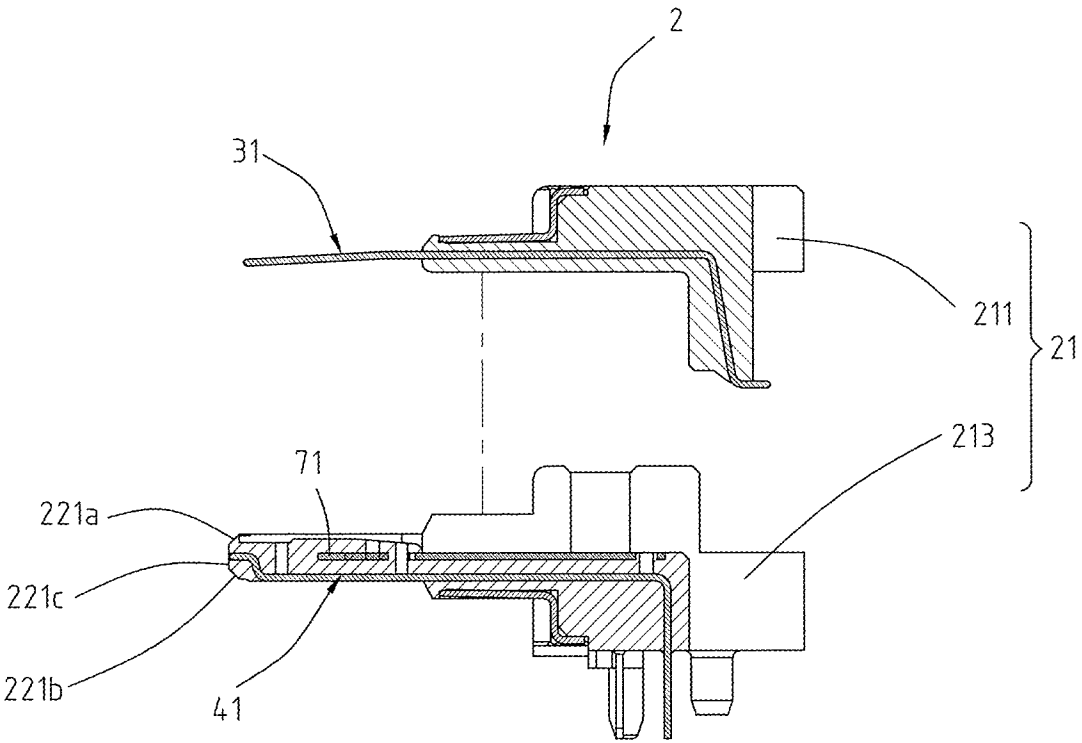
FIG. 4 illustrates a lateral sectional view of the electrical receptacle connector shown in FIG. 3.

Please refer to FIGS. 2 to 4. The second receptacle terminals 41 and the shielding plate 7 are held in the second terminal base 213. Each of the second receptacle terminals 41 comprises a flat contact portion 415 and a tail portion 416. Each of the tail portions 416 is extending from one end of the corresponding flat contact portion 415 and protruding from the mount member 21.

Please refer to FIGS. 2 and 4. The shielding plate 7 is held in the mount member 21 and the tongue portion 22. The shielding plate 7 comprises a plate body 71 and a plurality of legs 72. The plate body 71 is between the flat contact portions 315 of the first receptacle terminals 31 and the flat contact portions 415 of the second receptacle terminals 41. Specifically, the plate body 71 may be lengthened and widened, so that the front of the plate body 71 is near the front lateral surface 221*c* of the tongue portion 22, two sides of the plate body 71 is near two sides of the tongue portion 22 for contacting an electrical plug connector, and the rear of the plate body 71 is near the rear of the tongue portion 22. Accordingly, the plate body 71 can be disposed on the tongue portion 22 and the second terminal base 213, and the structural strength of the tongue portion 22 and the shielding performance of the tongue portion 22 can be improved.

Please refer to FIGS. 2, 3, and 5. The first receptacle terminals 31 comprise a plurality of first signal terminals 311, power terminals 312, and ground terminals 313. The first signal terminals 31 comprises a plurality of pairs of first high-speed signal terminals 3111/3113 and a pair of first low-speed signal terminals 3112. From a front view of the first receptacle terminals 31, the first receptacle terminals 31 comprise, from left to right, a ground terminal 313 (Gnd), a first pair of first high-speed signal terminals 3111 (TX1+–, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+–, differential signal terminals for low-speed signal transmission), a first supplement terminal 3142 (SBU1, a terminal can be reserved for other purposes), another power terminal 312 (Power/VBUS), a second pair of first high-speed signal terminals 3113 (RX2+–, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the first supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 3, 4, and 7. The first receptacle terminals 31 are held in the first terminal base 211 and formed as the upper-row terminals of the electrical receptacle connector 100. Each of the first receptacle terminals 31 comprises a flat contact portion 315, a body portion 317, and a tail portion 316. For each of the first receptacle terminals 31, the body portion 317 is held in the first terminal base 211, the flat contact portion 315 is extending forward from the body portion 317 in the rear-to-front direction and partly exposed upon the first surface 221*a* of the tongue portion 22, and the tail portion 316 is extending backward from the body portion 317 in the front-to-rear direction and protruding from the rear of the first terminal base 211. The first signal terminals 311 are disposed on the first surface 221*a* and transmit first signals (namely, USB 3.0 signals). The tail portions 316 are bent horizontally to form flat legs, named legs manufactured by SMT (surface mounted technology), which can be mounted or soldered on the surface of a printed circuit board by using surface mount technology. Alternatively, the tail portions 316 may be extending downwardly to form vertical legs, named legs manufactured by through-hole technology, which can be inserted into holes drilled in a printed circuit board (PCB).

Please refer to FIGS. 3, 4, and 7. The second receptacle terminals 41 comprise a plurality of second signal terminals 411, power terminals 412, and ground terminals 413. The second receptacle terminals 41 comprise a plurality of pairs of second high-speed signal terminals 4111/4113 and a pair of second low-speed signal terminals 4112. From a front view of the second receptacle terminals 41, the second receptacle terminals 41 comprise, from right to left, a ground terminal 413 (Gnd), a first pair of second high-speed signal terminals 4111 (TX2+–, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+–, differential signal terminals for low-speed signal transmission), a second supplement terminal 4142 (SBU2, a terminal can be reserved for other purposes), another power terminals 412 (Power/VBUS), a second pair of second high-speed signal terminals 4113 (RX1+–, differential signal terminals for high-speed signal transmission), and another ground terminal 413 (Gnd). In this embodiment, twelve second receptacle terminals 41 are provided for transmitting USB 3.0 signals. Each pair of the second high-speed signal terminals 4111/4113 is between the corresponding power terminal 412 and the adjacent ground terminal 413. The pair of the second low-speed signal terminals 4112 is between the second function detection terminal 4141 and the second supplement terminal 4142.

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 3, 4, and 7. The second receptacle terminals 41 are held in the second terminal base 213 and formed as the lower-row terminals of the electrical receptacle connector 100. In addition, the first receptacle terminals 31 are substantially aligned parallel with the second receptacle terminals 41. In this embodiment, each of the second receptacle terminals 41 comprises a flat contact portion 415, a body portion 417, and a tail portion 416. For each of the second receptacle terminals 41, the body portion 417 is held in the second terminal base 213 and the tongue portion 22, the flat contact portion 415 is extending from the body portion 417 in the rear-to-front direction and partly exposed upon the second surface 221*b* of the tongue portion 22, and the tail portion 416 is extending backward from the body portion 417 in the front-to-rear direction and protruding from the rear of the second terminal base 213. The second signal terminals 411 are disposed at the second surface 221*b* and transmit second signals (i.e., USB 3.0 signals). The tail portions 416 are bent horizontally to form flat legs, named legs manufactured by SMT (surface mounted technology), which can be mounted or soldered on the surface of a printed circuit board by using surface mount technology. Alternatively, the tail portions 416 may be extending downwardly to form vertical legs, named legs manufactured by through-hole technology, which can be inserted into holes drilled in a printed circuit board (PCB). The tail portions 316 of the first receptacle terminals 31 and the tail portions 416 of the second receptacle terminals 41 are arranged in a staggered manner from the top view.

Please refer to FIGS. 2 and 4. The legs 72 are extending from the rear portion of the shielding plate 7 to form vertical legs. That is, the legs 72 are exposed from the second terminal base 213 and in contact with a circuit board. In this embodiment, the crosstalk interference can be reduced by the shielding of the shielding plate 7 when the flat contact portions 315, 415 transmit signals. Furthermore, the structural strength of the tongue portion 22 can be improved by the assembly of the shielding plate 7. In addition, the legs 72 of the shielding plate 7 are exposed from the second terminal base 213 and in contact with the circuit board for conduction and grounding.

Please refer to FIGS. 2 and 3. The shielding plate 7 further comprises a plurality of hooks 73. The hooks 73 are extending outward from two sides of the front portion of the plate body 71 and protruding from the front lateral surface 221*c* and two sides of the tongue portion 22. When an electrical plug connector is mated with the electrical receptacle connector 100, elastic pieces at two sides of an insulated housing of the electrical plug connector are engaged with the hooks 73, and the elastic pieces would not wear against the tongue portion 22 of the electrical receptacle connector 100. Hence, the shielding plate 7 can be in contact with the metallic shell 11 for conduction and grounding.

Please refer to FIGS. 2, 3, and 5. In this embodiment, the first receptacle terminals 31 and the second receptacle terminals 41 are disposed upon the first surface 221*a* and the second surface 221*b* of the tongue portion 22, respectively, and pin-assignments of the first receptacle terminals 31 and the second receptacle terminals 41 are point-symmetrical with a central point of the receptacle cavity 112 as the symmetrical center. In other words, pin-assignments of the first receptacle terminals 31 and the second receptacle terminals 41 have 180-degree symmetrical design with respect to the central point of the receptacle cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221*a* is facing up, for transmitting first signals. Conversely, the electrical plug connector is inserted into the electrical receptacle connector 100 with a second orientation where the first surface 221*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIG. 2 and FIGS. 3 to 5. In this embodiment, as viewed from the front of the receptacle terminals 31, 41, the position of the first receptacle terminals 31 corresponds to the position of the second receptacle terminals 41. In other words, the positions of the flat contact portions 315 are respectively aligned with the positions of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the flat contact portions 315, 415, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (PowerNBUS) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (Power/VBUS) are retained.

As above, recesses are provided in the terminal grooves for receiving end portions of the flat contact portions of the first receptacle terminals, and the abutting surfaces of the end portions are abutted against the first lateral surfaces of the recesses. Therefore, when the tongue portion is inserted into or detached from an electrical plug connector, the end portions are constrainted in the recesses. As a result, upon the tongue portion is deflected, the flat contact portions are not detached from the tongue portion. Accordingly, the connector can provide good stability and reliability in the contact with the electrical plug connector. Moreover, the tongue portion comprises the through holes formed on the front lateral surface thereof and communicating with the recesses, respectively. Therefore, the recesses can be manufactured conveniently, and fixtures can be taken out of the tongue portion through the through holes after the recesses are manufactured. Additionally, the flat contact portions of the first receptacle terminals comprise the slant portions. When the slant portions are received in the terminal grooves, the slant portions continuously abut against the groove walls of the terminal grooves to prevent the flat contact portions from detaching off the tongue portion.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell comprising a receptacle cavity;

a mount member received in the receptacle cavity of the metallic shell;

a tongue portion integrally formed on one of two sides of the mount member, wherein the tongue portion comprises a plurality of terminal grooves, a plurality of recesses, and a plurality of through holes, the terminal grooves are formed on a first surface of the tongue portion, each of the recesses is recessed toward a tip of the tongue portion from an inner sidewall in the corresponding terminal groove, each of the recesses comprises two lateral surfaces and a bottom surface therein, for each of the recesses, a first lateral surface of the two lateral surfaces is extending from the inner sidewall toward an interior of the recess and connected to one of two opposite edges of the bottom surface, a second lateral surface of the lateral surfaces is extending from an inner surface of the corresponding terminal groove toward the interior of the recess and connected to the other edge of the bottom surface, and the through holes are foamed on a front lateral surface of the tongue portion and respectively communicating with the recesses;

a plurality of first receptacle terminals on a first side of the mount member, wherein each of the first receptacle terminals comprises a first flat contact portion and a first tail portion extending from one end of the first flat contact portion and protruding from the mount member, the first flat contact portions are held in the terminal grooves, end portions of the first flat contact portions are received in the recesses, abutting surfaces of end portions of the first flat contact portions are abutted against the first lateral surfaces of the recesses;

a plurality of second receptacle terminals on a second side of the mount member opposite to the first side, wherein each of the second receptacle terminals comprises a second flat contact portion and a second tail portion extending from one end of the second flat contact portion and protruding from the mount member, the second flat contact portions are held on a second surface of the tongue portion opposite to the first surface; and a shielding plate on the mount member and the tongue portion, wherein the shielding plate is between the first flat contact portions and the second flat contact portions.

2. The electrical receptacle connector according to claim 1, wherein the tongue portion comprises a plurality of limiting blocks formed on the first lateral surfaces of the recesses, the end portions of the first flat contact portions are abutted against the limiting blocks, respectively.

3. The electrical receptacle connector according to claim 1, wherein each of the first flat contact portions comprises a positioning portion and a slant portion outward extending from the positioning portion, and an end portion of the slant portion is inserted into the corresponding recess.

4. The electrical receptacle connector according to claim 1, wherein each of the first flat contact portions comprises a positioning portion and a parallel portion parallel to and outward extending from the positioning portion, and an end portion of the parallel portion is inserted into the corresponding recess.

5. The electrical receptacle connector according to claim 1, wherein the tongue portion comprises a plurality of protruding blocks respectively protruding from groove walls of the terminal grooves to abut against bottoms of the first flat contact portions.

6. The electrical receptacle connector according to claim 2, wherein each of the first flat contact portions comprises a positioning portion and a slant portion outward extending from the positioning portion, and an end portion of the slant portion is inserted into the corresponding recess.

7. The electrical receptacle connector according to claim 2, wherein each of the first flat contact portions comprises a positioning portion and a parallel portion parallel to and outward extending from the positioning portion, and an end portion of the parallel portion is inserted into the corresponding recess.

8. The electrical receptacle connector according to claim 2, wherein the tongue portion comprises a plurality of protruding blocks respectively protruding from groove walls of the terminal grooves to abut against bottoms of the first flat contact portions.

9. The electrical receptacle connector according to claim 1, wherein the mount member further comprises a first terminal base and a second terminal base, the first terminal base is assembled with the first receptacle terminals, the second terminal base is integrally formed with the tongue portion and is assembled with the second receptacle terminals, the first terminal base is assembled on the second terminal base.

10. The electrical receptacle connector according to claim 2, wherein the mount member further comprises a first terminal base and a second terminal base, the first terminal base is assembled with the first receptacle terminals, the second terminal base is integrally formed with the tongue portion and is assembled with the second receptacle terminals, the first terminal base is assembled on the second terminal base.

11. The electrical receptacle connector according to claim 1, wherein the mount member comprises a plurality of first assembling grooves, and the first receptacle terminals are assembled in the first assembling grooves, respectively.

12. The electrical receptacle connector according to claim 2, wherein the mount member comprises a plurality of first assembling grooves, and the first receptacle terminals are assembled in the first assembling grooves, respectively.

13. The electrical receptacle connector according to claim 1, wherein the mount member comprises a plurality of second assembling grooves, and the second receptacle terminals are assembled in the second assembling grooves, respectively.

14. The electrical receptacle connector according to claim 2, wherein the mount member comprises a plurality of second assembling grooves, and the second receptacle terminals are assembled in the second assembling grooves, respectively.

15. The electrical receptacle connector according to claim 1, wherein the first receptacle terminals are on the first surface of the tongue portion, the second receptacle terminals are on the second surface of the tongue portion, and wherein the first receptacle terminals and the second receptacle terminals have 180 degree symmetrical design with respect to a central point of the receptacle cavity as the symmetrical center.

* * * * *